US011279053B2

(12) United States Patent
Lessmann et al.

(10) Patent No.: US 11,279,053 B2
(45) Date of Patent: Mar. 22, 2022

(54) SAFETY RAZOR AND BLADE UNIT FOR SAFETY RAZOR

(71) Applicant: BEIERSDORF AG, Hamburg (DE)

(72) Inventors: Michael Lessmann, Hamburg (DE); Jens Treu, Hamburg (DE); Kesen Zeng, Hamburg (DE); Yvonne Neumann, Hamburg (DE); Hiroyuki Nakasuka, Gifu (JP)

(73) Assignee: KAI R&D CENTER CO., LTD., Gifu-Ken (JP)

( * ) Notice: Subject to any disclaimer, the term of this patent is extended or adjusted under 35 U.S.C. 154(b) by 794 days.

(21) Appl. No.: 15/329,073

(22) PCT Filed: Apr. 27, 2015

(86) PCT No.: PCT/EP2015/059067
§ 371 (c)(1),
(2) Date: Jan. 25, 2017

(87) PCT Pub. No.: WO2016/015881
PCT Pub. Date: Feb. 4, 2016

(65) Prior Publication Data

US 2017/0217034 A1 Aug. 3, 2017

(30) Foreign Application Priority Data

Jul. 31, 2014 (EP) ..... 14179271

(51) Int. Cl.
*B26B 21/44* (2006.01)
*B26B 21/40* (2006.01)
(Continued)

(52) U.S. Cl.
CPC ..... *B26B 21/443* (2013.01); *B26B 21/06* (2013.01); *B26B 21/227* (2013.01);
(Continued)

(58) Field of Classification Search
CPC ..... B26B 21/06; B26B 21/14; B26B 21/22; B26B 21/227; B26B 21/4012;
(Continued)

(56) References Cited

U.S. PATENT DOCUMENTS 6,675,479 B1 * 1/2004 Walker, Jr ..... B26B 21/4018 30/34.2
2004/0261271 A1 * 12/2004 Coffin ..... B26B 21/225 30/50

(Continued)

FOREIGN PATENT DOCUMENTS

JP 2014090933 A * 5/2014 ..... B26B 21/4012

OTHER PUBLICATIONS

JP2014090933 translation.*
Daisuke JP 20114-090933 translation, 2014.*

*Primary Examiner* — Jason Daniel Prone
*Assistant Examiner* — Samuel A Davies
(74) *Attorney, Agent, or Firm* — Abel Schillinger, LLP

(57) ABSTRACT

Disclosed is a blade unit for a safety razor comprising a connecting structure for fixing the blade unit to a handle, a blade housing comprising a plurality of blades having cutting edges lying in a shaving plane, and a rear portion next to the plurality of blades, comprising a non-flexible back portion extending parallel to the shaving plane, and a lubricating pad having a flexible portion and a non-flexible portion, the non-flexible portion being arranged on and supported by the non-flexible back portion, the flexible portion extending rearwards from the non-flexible portion beyond the non-flexible back portion to define a rear edge of the rear portion of the blade unit, the flexible portion forming a convex skin-contacting surface when bending away from the shaving plane in use.

20 Claims, 14 Drawing Sheets

(51) Int. Cl.
*B26B 21/06* (2006.01)
*B26B 21/22* (2006.01)

(52) U.S. Cl.
CPC ..... *B26B 21/4025* (2013.01); *B26B 21/4068* (2013.01); *B26B 21/44* (2013.01)

(58) Field of Classification Search
CPC ..... B26B 21/4018; B26B 21/4025; B26B 21/4068; B26B 21/44; B26B 21/443
See application file for complete search history.

(56) References Cited

U.S. PATENT DOCUMENTS

| | | | | |
|---|---|---|---|---|
| 2006/0080837 | A1 | 4/2006 | Johnson et al. | |
| 2011/0016724 | A1* | 1/2011 | Murgida | B26B 21/225 30/50 |
| 2011/0126413 | A1 | 6/2011 | Szczepanowski et al. | |
| 2011/0247216 | A1* | 10/2011 | Johnson | B26B 21/4018 30/41 |
| 2011/0247217 | A1* | 10/2011 | Johnson | B26B 21/225 30/50 |
| 2012/0151772 | A1 | 6/2012 | Moon et al. | |

* cited by examiner

SAFETY RAZOR AND BLADE UNIT FOR SAFETY RAZOR

FIELD

Embodiments described herein relate to safety razors and blade units for safety razors.

BACKGROUND

Safety razors are typically composed of a blade unit connected, either detachably or fixedly (permanently fixed or integrated), to a handle. Blade units are known which have one or more blades, often a plurality of parallel blades, each defining a cutting edge, with blade unit elements positioned in front of and behind (rear of) the cutting edge(s) (referred to as a "guard" and a "cap", respectively) in a shaving direction. A shaving aid, such as a lubricating strip, is often incorporated in one or both of these blade unit elements to improve shaving performance and lubricating treatment of the user's skin.

The shape of the blade unit, and type of shaving aid employed, can affect shaving performance. For example, while blade units having a rectangular, planar and/or block-type shape provide good performance for shaving relatively flat, large skin surface areas, their use for shaving more contoured, smaller skin surface areas such as those around the ankles, behind the knees and under the arms, can be more problematic.

It would be desirable to provide an improved blade unit.

SUMMARY OF THE INVENTION

One aspect provides a blade unit for a safety razor, comprising: a connecting structure configured to fix the blade unit to a handle; a blade housing comprising a plurality of blades having respective cutting edges lying in a shaving plane and being arranged to exert a cutting action when moved across a user's skin in a shaving direction; and a rear portion arranged next to the plurality of blades in the shaving direction, comprising a non-flexible back portion extending parallel to the shaving plane, and a lubricating pad consisting of a flexible portion and a non-flexible portion, the non-flexible portion of the lubricating pad being arranged on and supported by the non-flexible back portion, the flexible portion of the lubricating pad extending rearwards from the non-flexible portion of the lubricating pad beyond the non-flexible back portion to define a rear edge of the rear portion of the blade unit, the flexible portion of the lubricating pad being configured to form a convex skin-contacting surface when bending away from the shaving plane in use.

The provision of a lubricating pad with a flexible portion configured to form a convex skin-contacting surface when bending away from the shaving plane in use, allows the lubricating pad to better follow the contours of skin surface areas, and in particular the concave skin surface areas such as those around the ankles, behind the knees and under the arms. Furthermore, because the flexible portion of the lubricating pad extends rearwards (protrudes) from the non-flexible portion to define a rear edge (tip) of the rear portion of the blade unit, no separate element (e.g., no separate frame) needs to be provided around an outer perimeter of the blade unit for fixing the elements of the blade unit (such as the blade housing and the rear portion, and in particular, the lubricating pad and the non-flexible back portion) to each other, as such elements are, for example, adhered, integrated, bonded and/or otherwise attached to each other.

Thus, the size of the skin-contacting surface can be maximised while keeping the size and volume of the blade unit in a reasonable format and no frame edges may disturb the shaving process on the user's skin. As such, the shaving resistance due to contact between the blade unit and the skin surface is lessened during use so that the tactile sensation on the skin surface is improved.

In one embodiment, a back surface of the lubricating pad, opposite to the skin-contacting surface, is planar. In another embodiment, a back surface of the lubricating pad, opposite to the skin-contacting surface, has an inward step. The term "inward" means in a direction toward the skin-contacting surface. The inward step can be formed at a boundary between the non-flexible portion of the lubricating pad and the flexible portion of the lubricating pad. In this way, the lubricating pad, and more specifically the flexible portion of the lubricating pad, can have different thicknesses and thus different degrees of flexibility. That is to say, the flexible portion of the lubricating pad can be thicker and therefore relatively more resistant to bending (i.e., less flexible) by contact with a skin surface during use, or thinner and therefore relatively less resistant to bending (i.e., more flexible) by contact with a skin surface during use. In both cases, the flexible portion of the lubricating pad can bend (in a cantilever manner) with respect to the other elements of the blade unit and return substantially to its position and shape prior to contact with the skin surface after use, while the non-flexible portion of the lubricating pad does not substantially bend during use (although the non-flexible portion can be deformed by, for example, a compressive force).

Other and/or additional configurations of the lubricating pad are possible. For example, the rear edge defined by the flexible portion of the lubricating pad can be chamfered on the skin-contacting surface side. This improves the tactile sensation on the skin surface when the lubricating pad is brought into contact with the skin surface during shaving. Also, the thickness of the flexible portion of the lubricating pad can be thinner than the thickness of the non-flexible portion of the lubricating pad. For example, the skin-contacting surface of the lubricating pad can curve towards the opposite, back surface. The radius of curvature of the skin-contacting surface can be set to about 30 mm, which is within a preferred range from 20 to 100 mm. This allows the non-flexible portion of the lubricating pad to bend more easily.

In one embodiment, the flexible portion of the lubricating pad is curved in an arc shape along the rear edge. That is, the lubricating pad narrows from the centre towards the side portions of the blade unit. This allows the blade unit to easily turn and follow the contours of skin surface areas.

In one embodiment, the non-flexible back portion comprises a straight member and an arched member that are connected to each other so as to define at least one hole (or recess) in which part of the non-flexible portion of the lubricating pad is disposed. In this way, the lubricating pad can be fixed (for example, adhered) to the non-flexible back portion in a straightforward manner.

In one embodiment, the blade unit further comprises: a forward portion arranged next to the plurality of blades in the shaving direction on an opposite side of the rear portion, comprising a non-flexible back portion extending parallel to the shaving plane, and an elongate lubricating strip arranged on and being supported by the non-flexible back portion and which extends up to a front edge of the forward portion of the blade unit. A skin-contacting surface area of the lubricating pad can be greater than a skin-contacting surface area of the elongate lubricating strip. The provision of an elongate lubricating strip on the front edge of the blades provides delivery of lubricant to the skin shortly before the cutting edges of the blades move across the skin during the shaving process, while minimising clogging of the blades. Herein, the term "rear" is used to describe features of the blade unit that are positioned behind the blades when the blade unit is drawn over the skin, while the term "forward" is used to describe features of the blade unit that are positioned in front the blades when the blade unit is drawn over the skin. The term "front" is used to describe features of the blade unit that are positioned on the skin-contacting side of the blade unit (i.e., on a front-side of the blade unit), and the term "back" is used to described features of the blade unit that are positioned on a side opposite the skin-contacting side of the blade unit (i.e., on a back-side of the blade unit). The lubricating strip can be injection-molded to the forward portion together and simultaneously with the lubricating pad of the rear portion, and can be integrally attached to the non-flexible back portion.

In one embodiment, the rear portion of the blade unit and the forward portion of the blade unit are connected by side portions of the blade unit, to define a supporting structure for the blade housing. Such a supporting structure offers control of the blade housing during shaving. The supporting structure can be molded from resin.

In one embodiment, the lubricating pad and elongate lubricating strip extend along at least 60%, and preferably at least 80%, of an outer perimeter of the blade unit when viewed from a direction perpendicular onto the shaving plane. Covering a majority of an outer perimeter with lubricating elements reduces friction between the blade unit and the skin, helping to prevent minor cuts and pulling/tugging (as opposed to cutting) of hair.

In one embodiment, the lubricating pad extends along at least 30%, and preferably at least 40%, of an outer perimeter of the blade unit when viewed from a direction perpendicular onto the shaving plane. This helps to treat the skin after encountering the blades.

In one embodiment, the skin-contacting surface of the lubricating pad is provided with a recess. Moisture can be retained in such a recess, so that lubricity is increased.

In one embodiment, the lubricating pad is integrally attached to the rear portion of the blade unit by injection molding. In one embodiment, the flexible portion of the lubricating pad comprises an elastic material such as, for example, a molded material including a water-soluble component (e.g., water-soluble polyethylene oxide) and a water-insoluble component (e.g., soft plastic such as elastomer resin as an elastic material). This allows the flexible portion to be easily elastically deformed. The weight proportion of the soft resin in the water-soluble component in relation to the weight of the entire lubricating pad can be set larger than the weight proportion of the water-soluble component in relation to the weight of the entire lubricating pad. For example, the elastomer resin can be set to have a weight proportion of not less than 30% such as, for example, a weight proportion of 50% or larger, and the water-soluble component can be set to have a weight proportion of not more than 50% such as, for example, a weight proportion of 15%. The flexible and non-flexible portions of the lubricating pad can be formed from a continuous piece of material, i.e., without requiring hinges or similar types of connectors therebetween, hence providing a simpler structure.

One aspect provides a safety razor, comprising: the aforementioned blade unit; and a handle having a proximal portion to which the blade unit is fixed and a distal portion. The blade unit can be detachably connected or fixedly connected (permanently fixed or integrated) to the handle. The safety razor can include a pivoting mechanism that allows the blade unit to pivot with respect to the handle. The pivoting mechanism can allow the blade unit to pivot in any of three dimensional directions. The pivoting mechanism can allow the blade unit to most easily pivot upwards. The pivot mechanism can be set such that, during shaving, the lubricating pad bends and blade unit pivots substantially at the same time. Alternatively, the lubricating pad can bend before the blade unit pivots, or vice versa.

In one embodiment, the handle comprises a proximal portion to which the blade unit is fixed and a distal portion, wherein the proximal portion arcuately bends away from the shaving plane. Such a configuration permits the blade unit to pivot backwards over a large angular range, that is, the curvature of the proximal portion allows the blade unit to pivot without being impaired by (hitting against) the handle during use. Additionally, or alternatively, the connecting structure can be provided on the back side of the blade unit opposite to the forward portion.

One aspect provides a method of manufacturing a blade unit for a safety razor, comprising: providing a connecting structure configured to fix the blade unit to a handle; providing a blade housing comprising a plurality of blades having respective cutting edges lying in a shaving plane and being arranged to exert a cutting action when moved across a user's skin in a shaving direction; and providing a rear portion arranged next to the plurality of blades in the shaving direction, comprising a non-flexible back portion extending parallel to the shaving plane, and a lubricating pad consisting of a flexible portion and a non-flexible portion, the non-flexible portion of the lubricating pad being arranged on and supported by the non-flexible back portion, the flexible portion of the lubricating pad extending rearwards from the non-flexible portion of the lubricating pad beyond the non-flexible back portion to define a rear edge of the rear portion of the blade unit, the flexible portion of the lubricating pad being configured to form a convex skin-contacting surface when bending away from the shaving plane in use.

The above indicated aspects and embodiments may be combined with each other to achieve the advantageous effects as described above. Further embodiments, features, and advantages of the invention, as well as the structure and operation of the various embodiments of the invention are described in detail below with reference to the accompanying drawings.

BRIEF DESCRIPTION OF THE DRAWINGS

The accompanying drawings, which are incorporated herein and form a part of the specification, illustrate the present invention and, together with the description, further serve to explain the principles of the invention and to enable a person skilled in the pertinent art to make and use the invention.

DETAILED DESCRIPTION OF EMBODIMENTS

The following detailed description refers to the accompanying drawings that illustrate exemplary embodiments consistent with this invention. Other embodiments are possible, and modifications can be made to the embodiments within the spirit and scope of the invention. Therefore, the detailed description is not meant to limit the invention.

Figure 1:
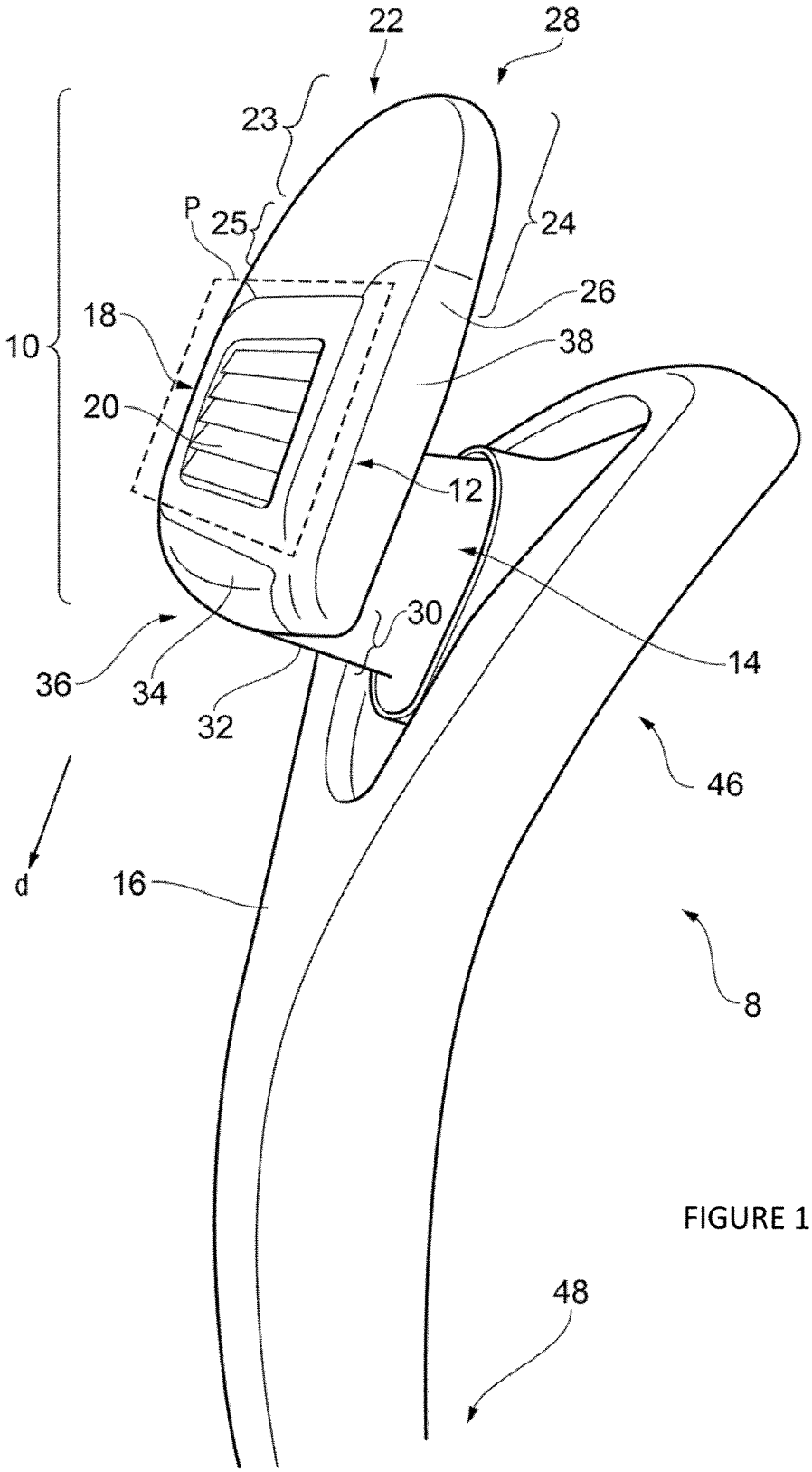
FIG. 1 is a perspective view of a safety razor including a blade unit according to a first embodiment.
Figure 2:
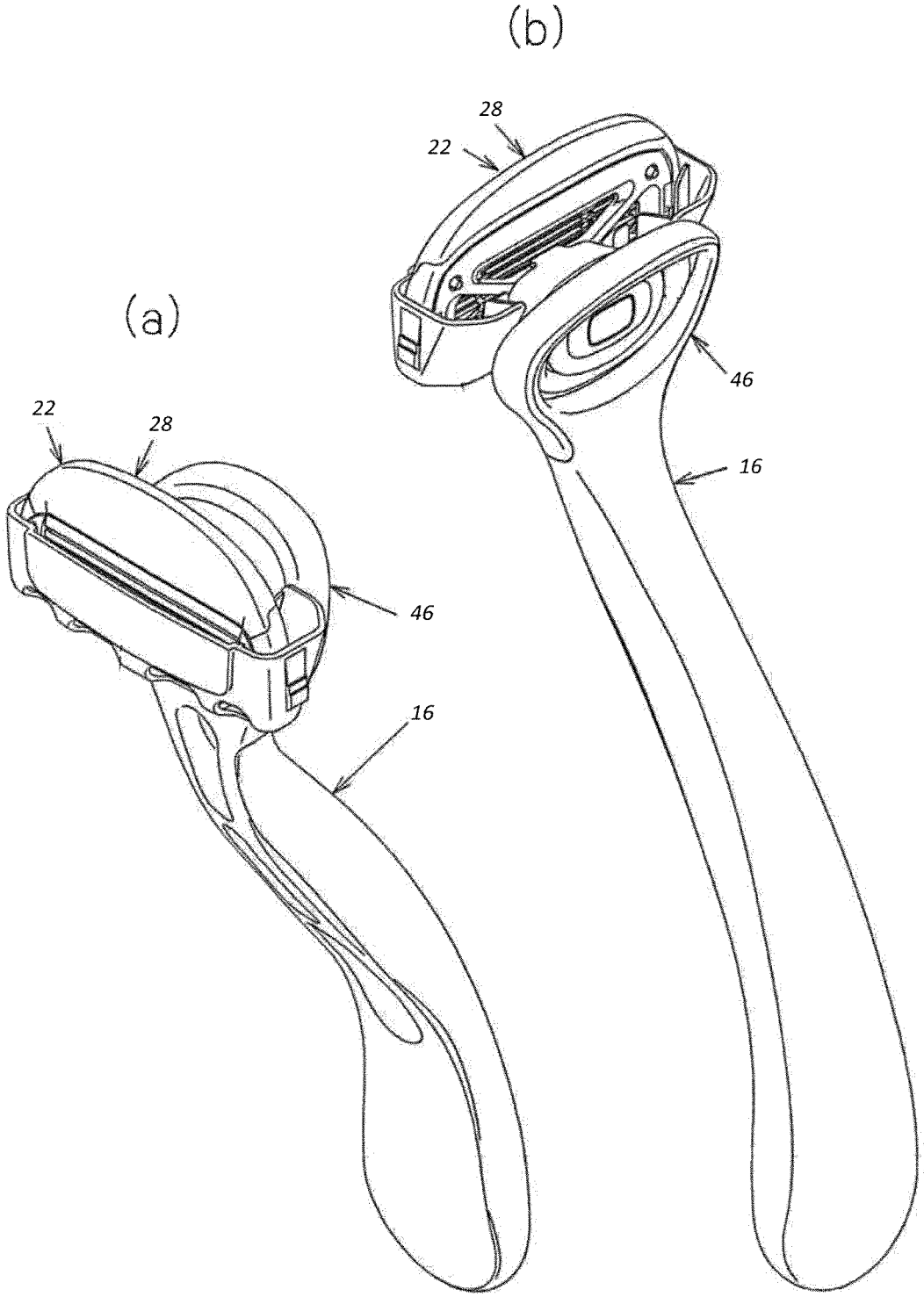
FIGS. 2(*a*) and (*b*) are further perspective views of the safety razor including the blade unit according to the first embodiment.
Figure 3:
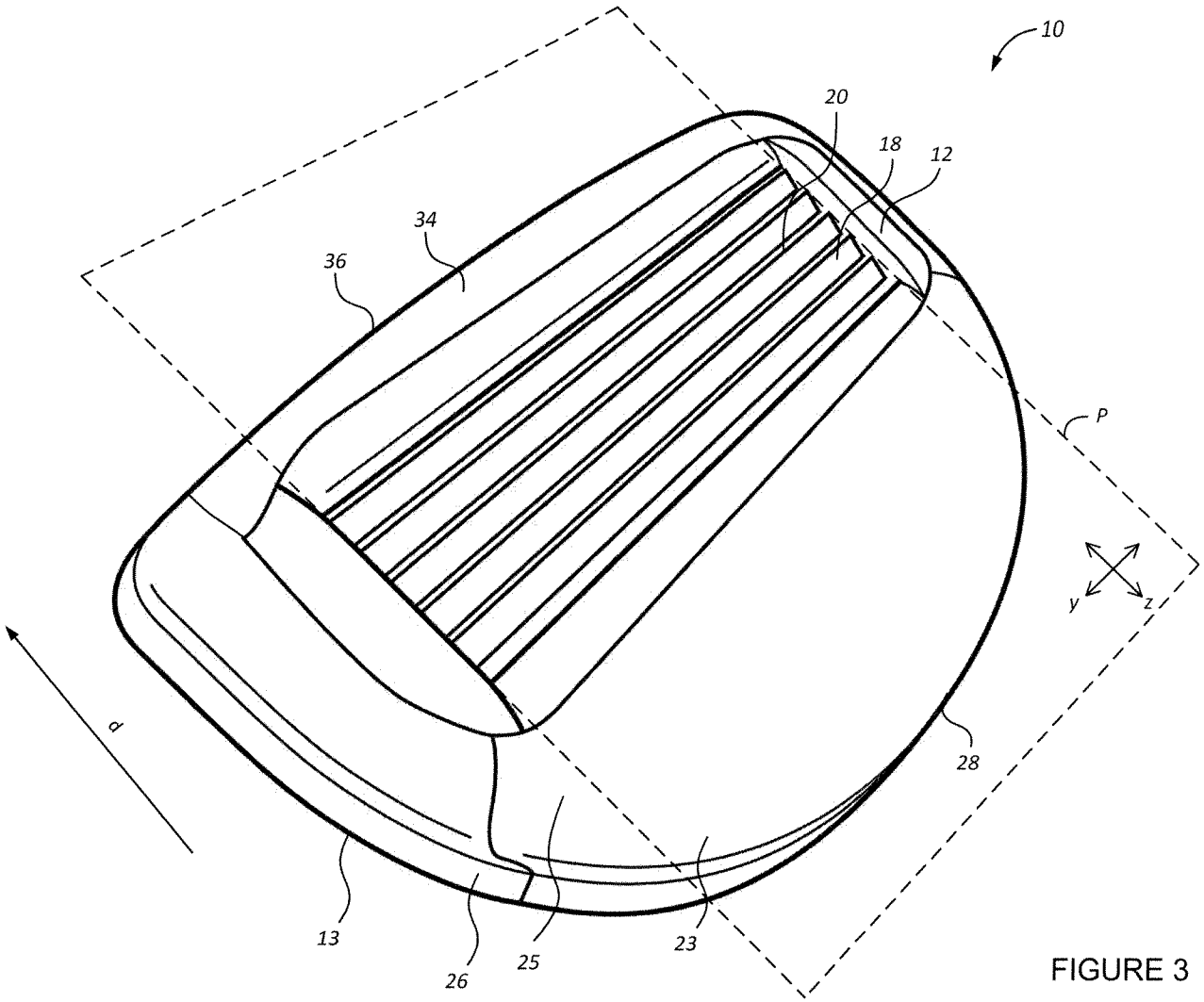
FIG. 3 is a perspective view of the blade unit shown in FIGS. 1 and 2.
Figure 4:
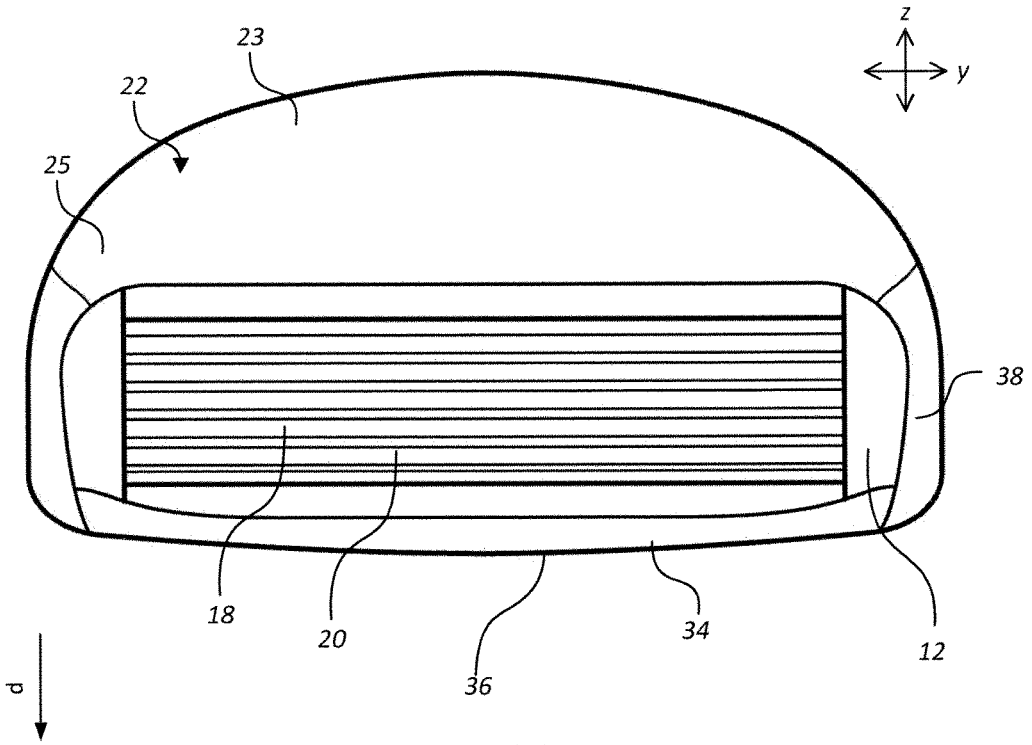
FIG. 4 is a bottom view of the blade unit shown in FIGS. 1 and 2.
Figure 5:
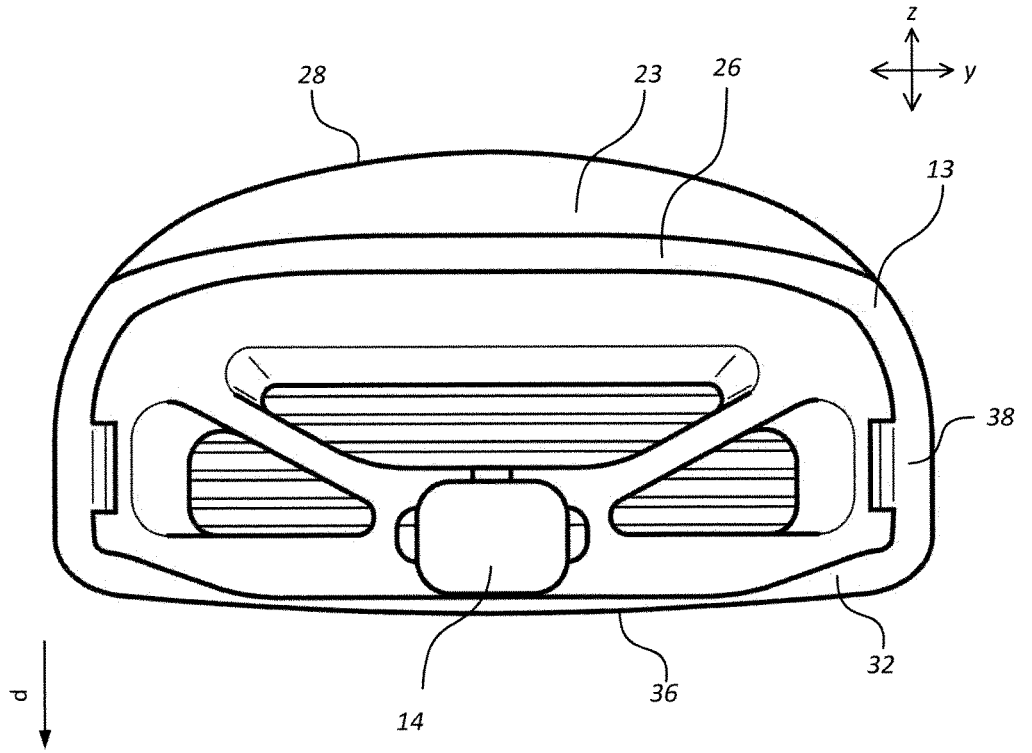
FIG. 5 is a top view of the blade unit shown in FIGS. 1 and 2.
Figure 6:
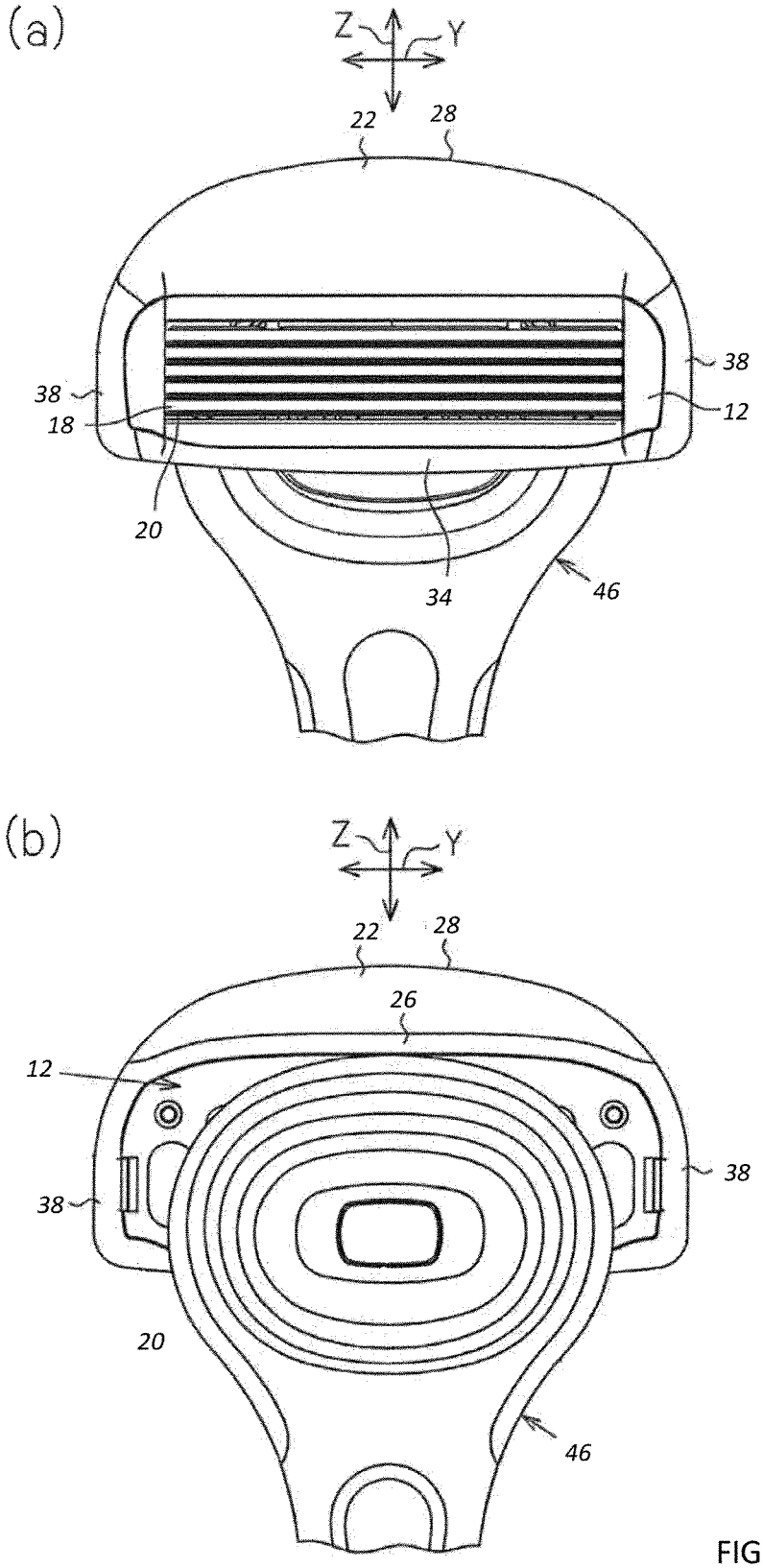
FIGS. 6(*a*) and (*b*) are further bottom and top views of the blade unit shown in FIGS. 1 and 2.
Figure 7:
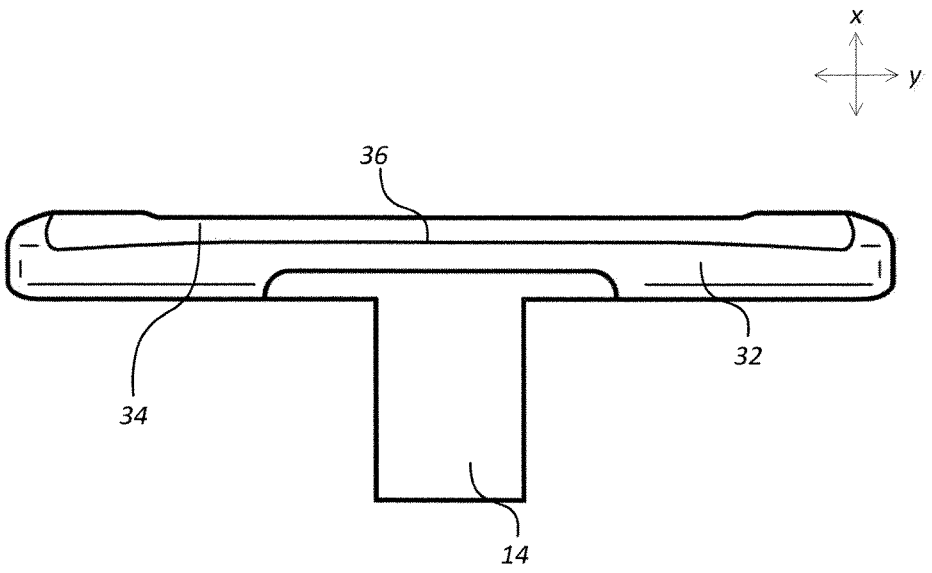
FIG. 7 is a front view of the blade unit shown in FIGS. 1 and 2.
Figure 8:
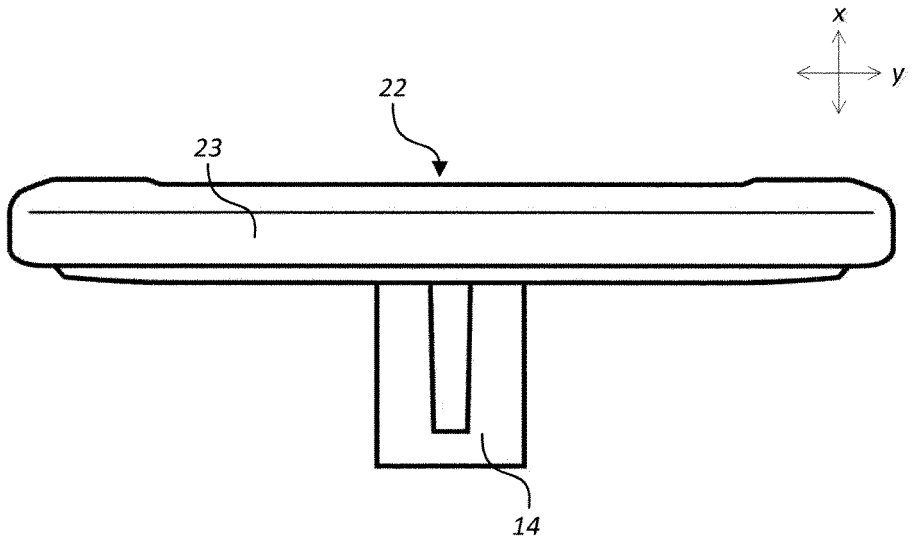
FIG. 8 is a back view of the blade unit shown in FIGS. 1 and 2.
Figure 9:
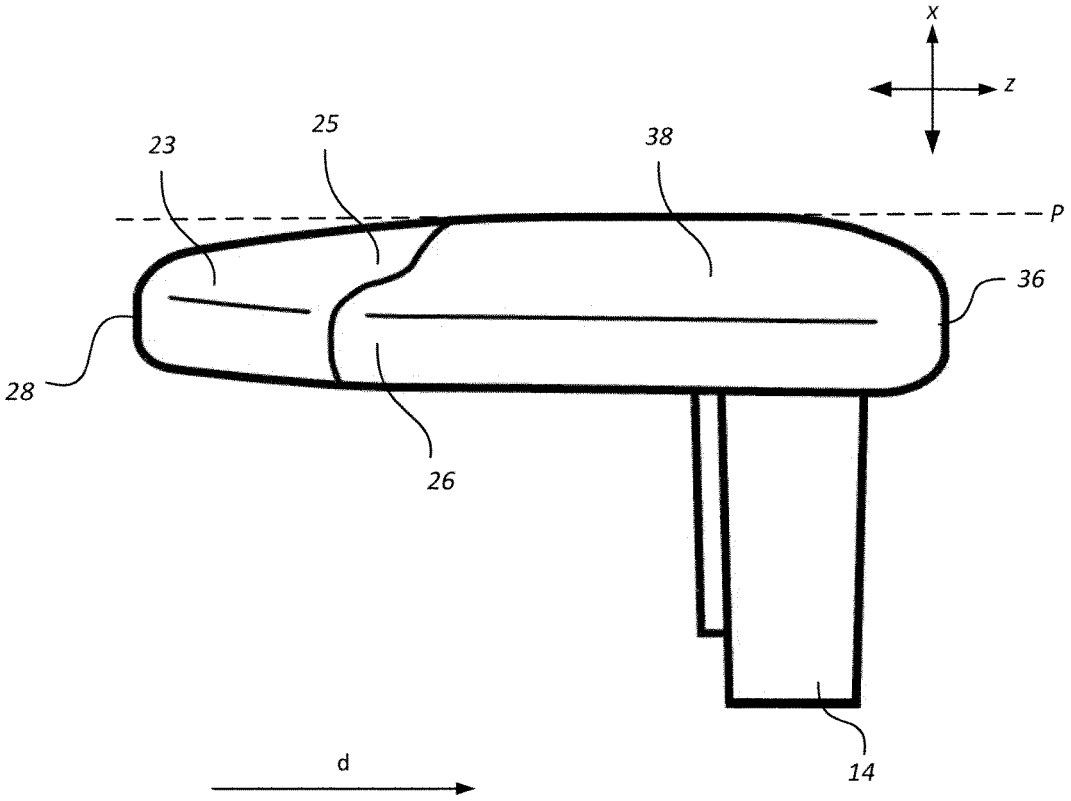
FIG. 9 is a side view of the blade unit shown in FIGS. 1 and 2.
Figure 10:
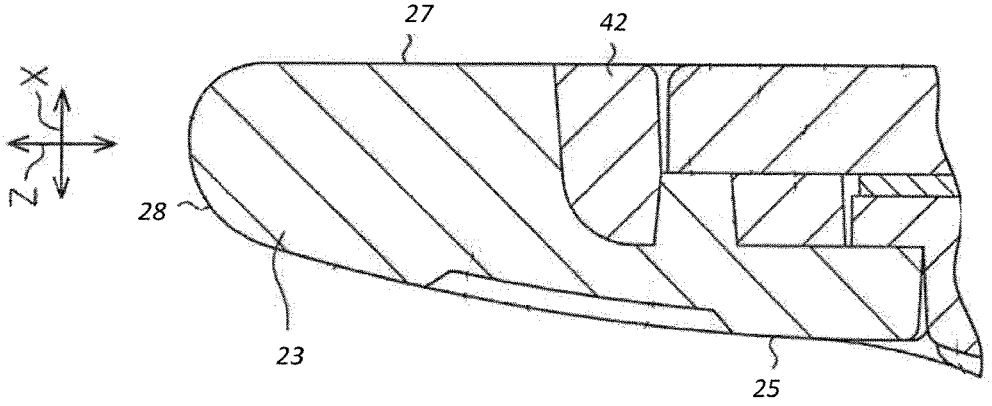
FIG. 10 is a cross-sectional view of the rear portion of the blade unit shown in FIGS. 1 and 2.
Figure 11:
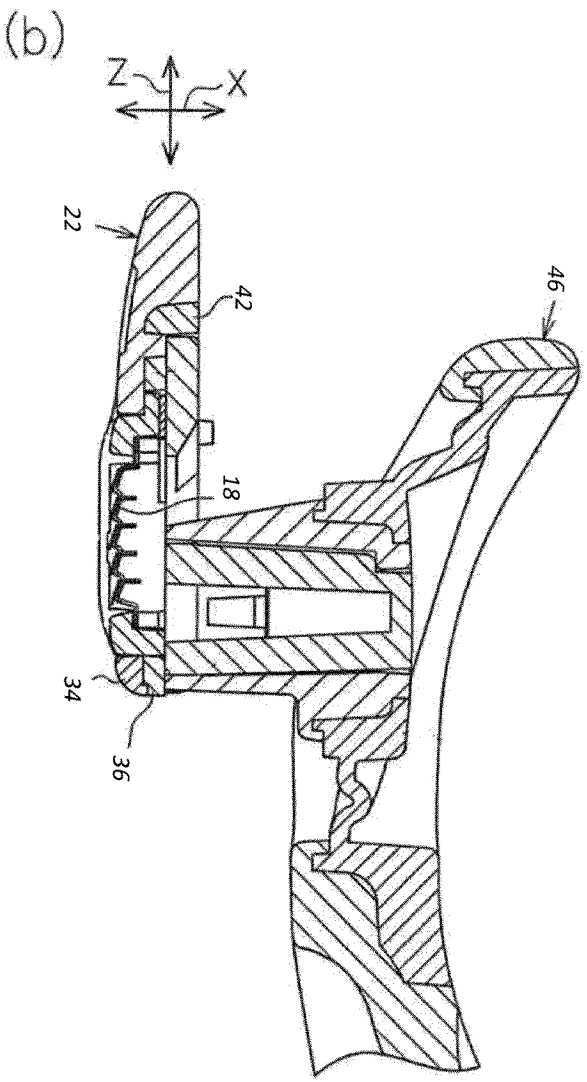
FIGS. 11(*a*) and (*b*) are a cross-sectional view of the blade unit and a side view of the blade unit, respectively, shown in FIGS. 1 and 2.
Figure 11:
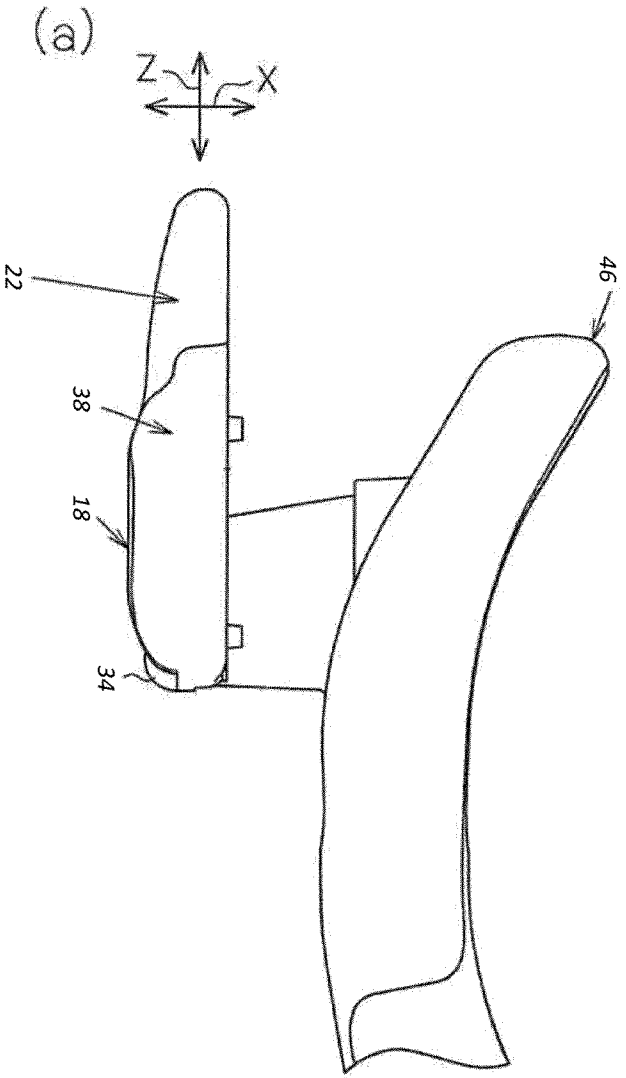
Figure 12:
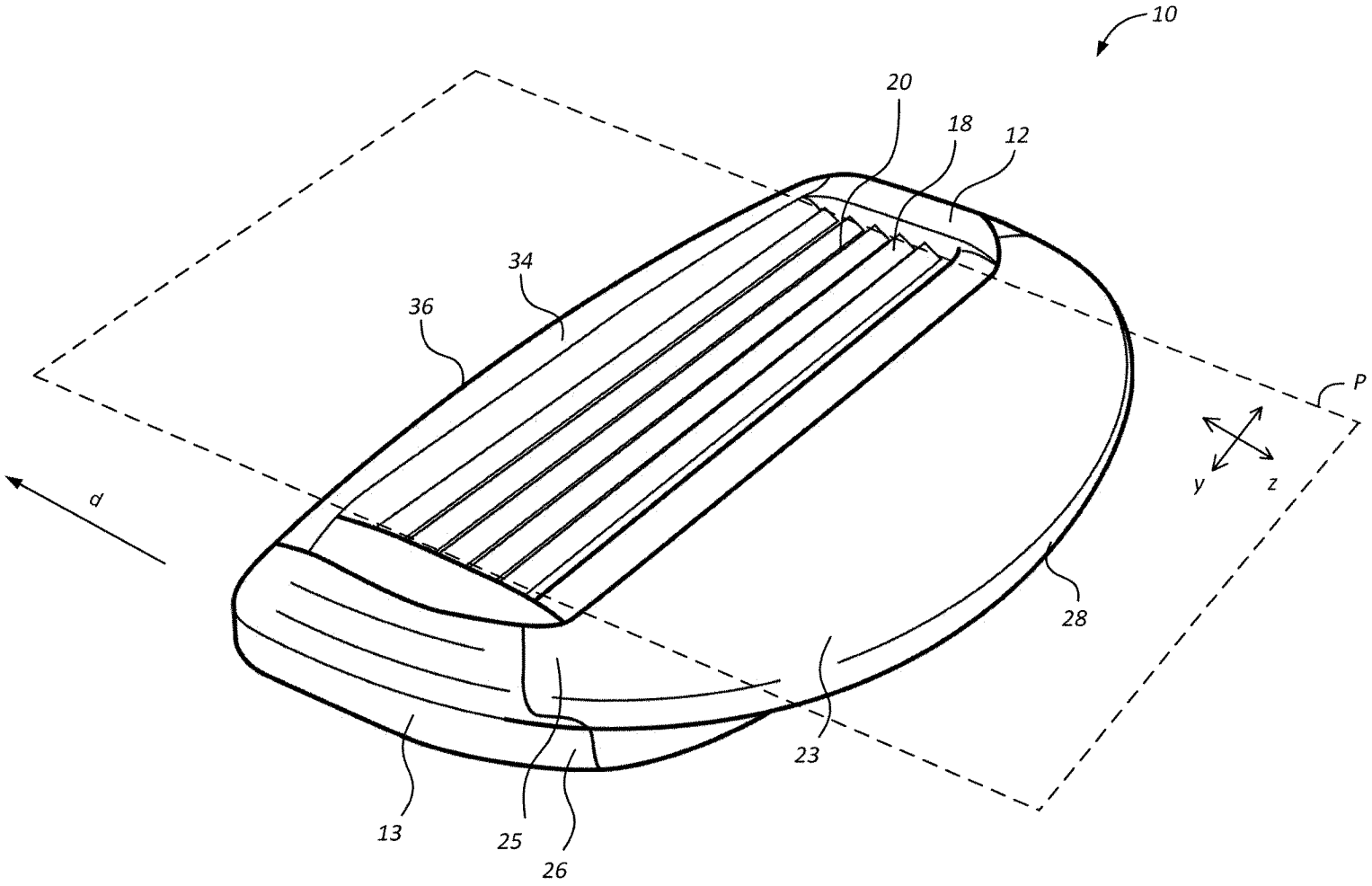
FIG. 12 is a perspective view of the blade unit according to a second embodiment.
Figure 13:
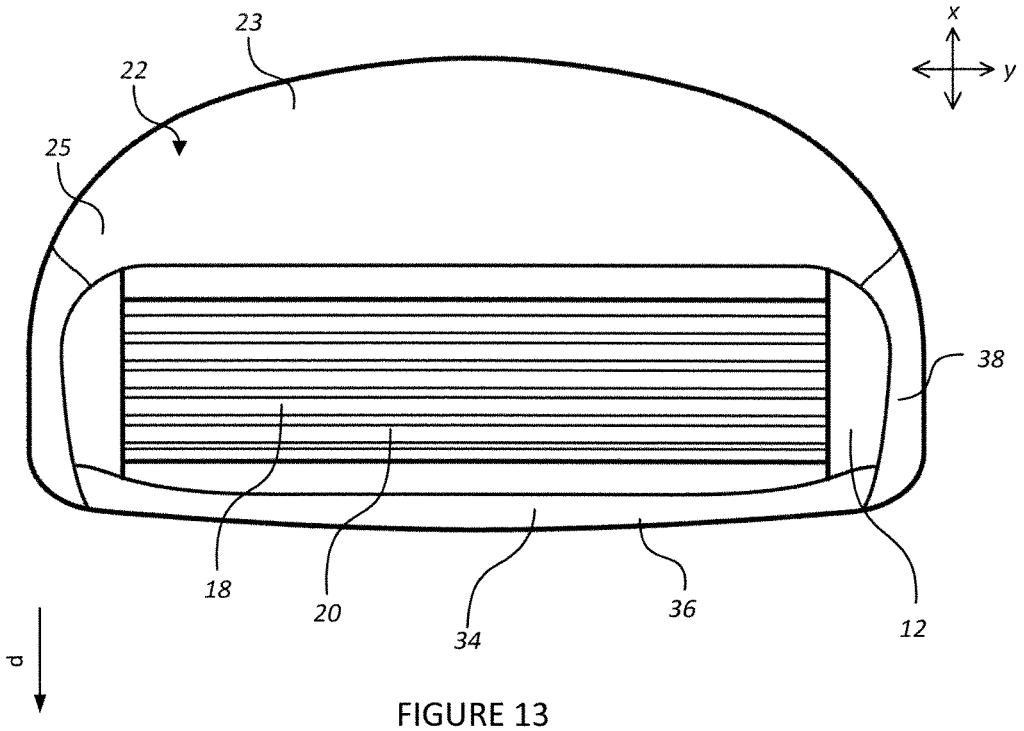
FIG. 13 is a bottom view of the blade unit shown in FIG. 12.
Figure 14:
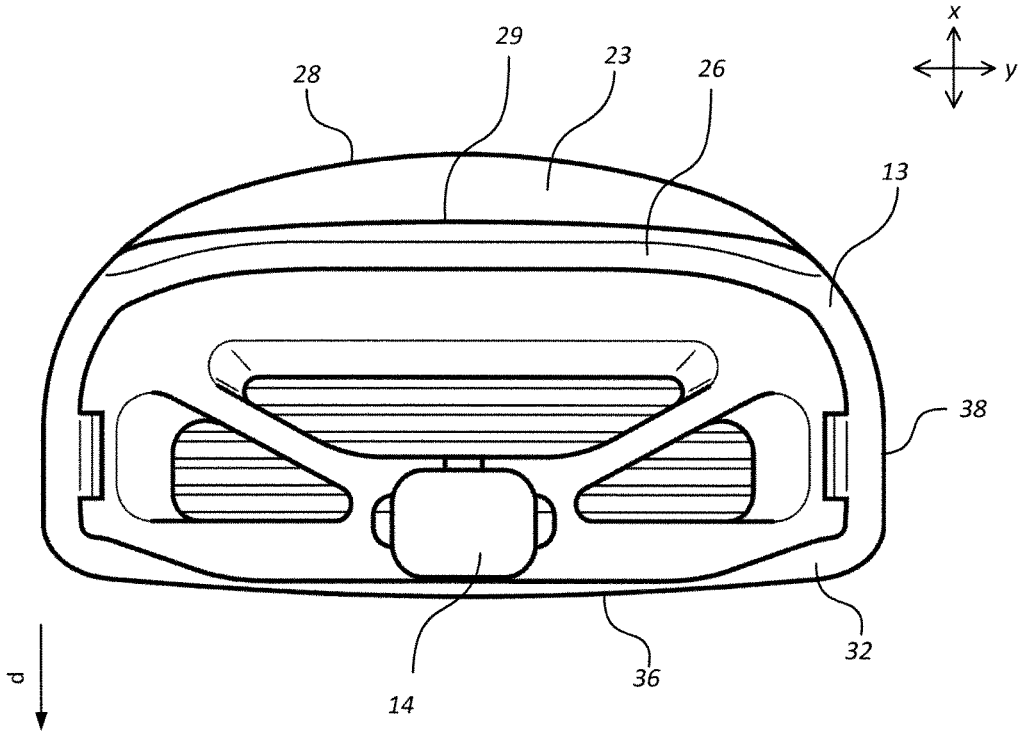
FIG. 14 is a top view of the blade unit shown in FIG. 12.
Figure 15:
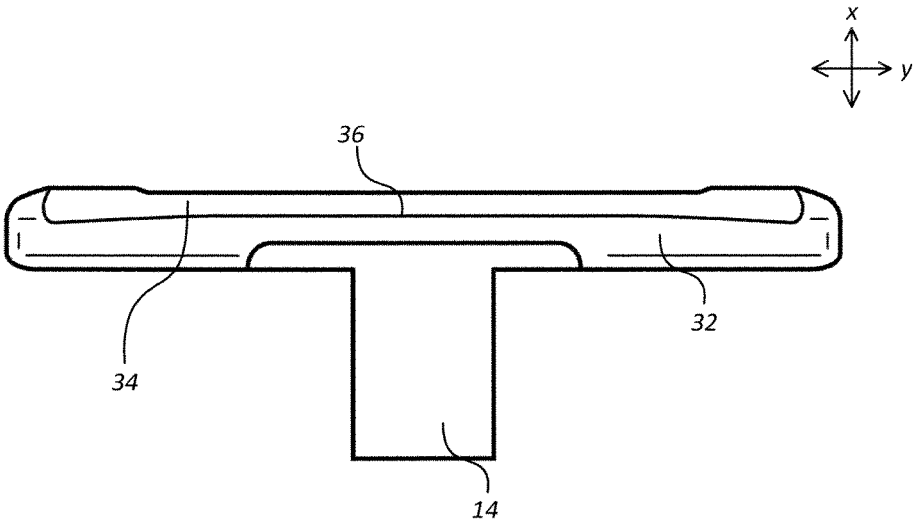
FIG. 15 is a front view of the blade unit shown in FIG. 12.
Figure 16:
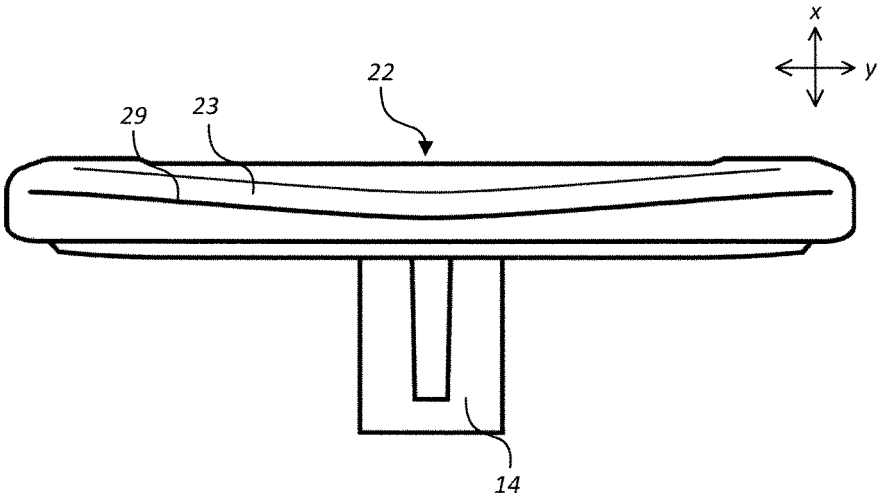
FIG. 16 is a back view of the blade unit shown in FIG. 12.
Figure 17:
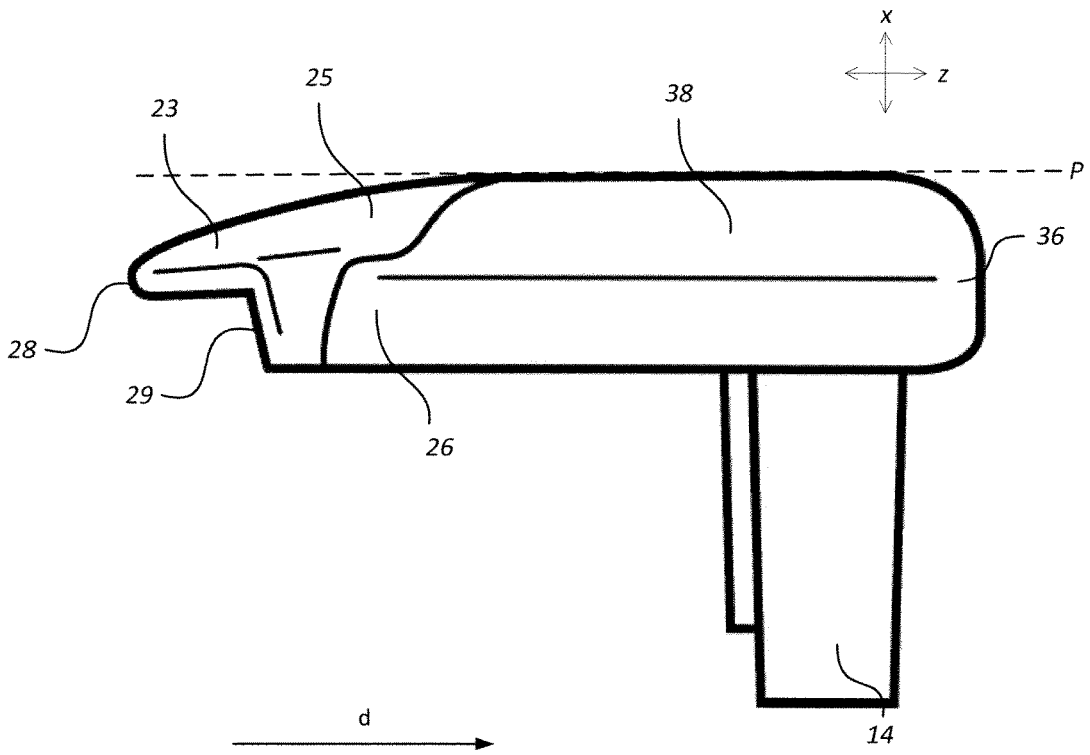
FIG. 17 is a side view of the blade unit shown in FIG. 12.
Figure 18:
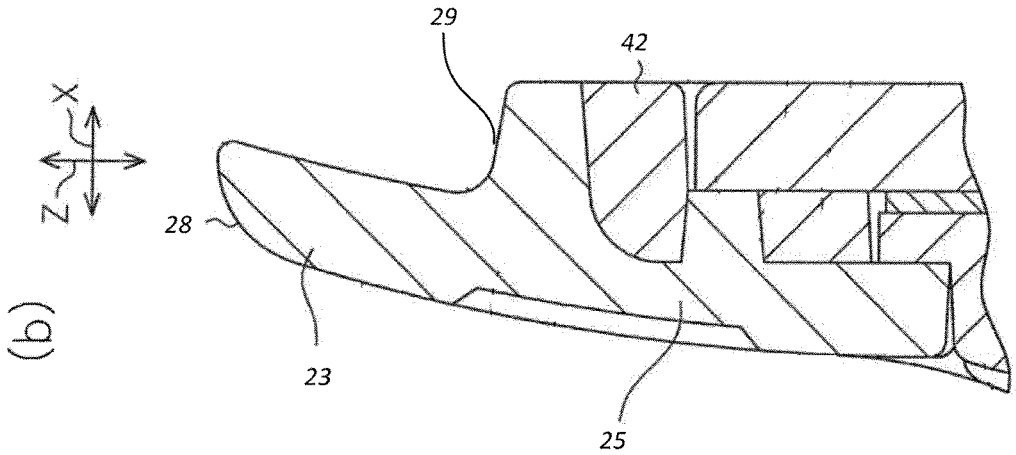
FIGS. 18(*a*) and (*b*) are a cross-sectional view of the rear portion of the blade unit and a top view of the blade unit, respectively, shown in FIG. 12.
Figure 18:
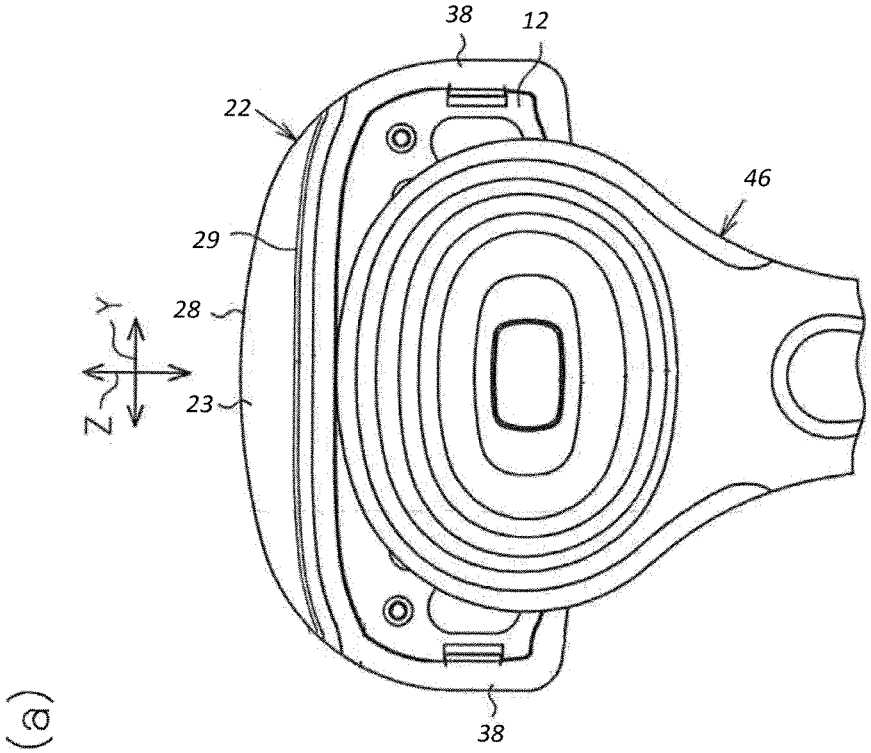
Figure 19:
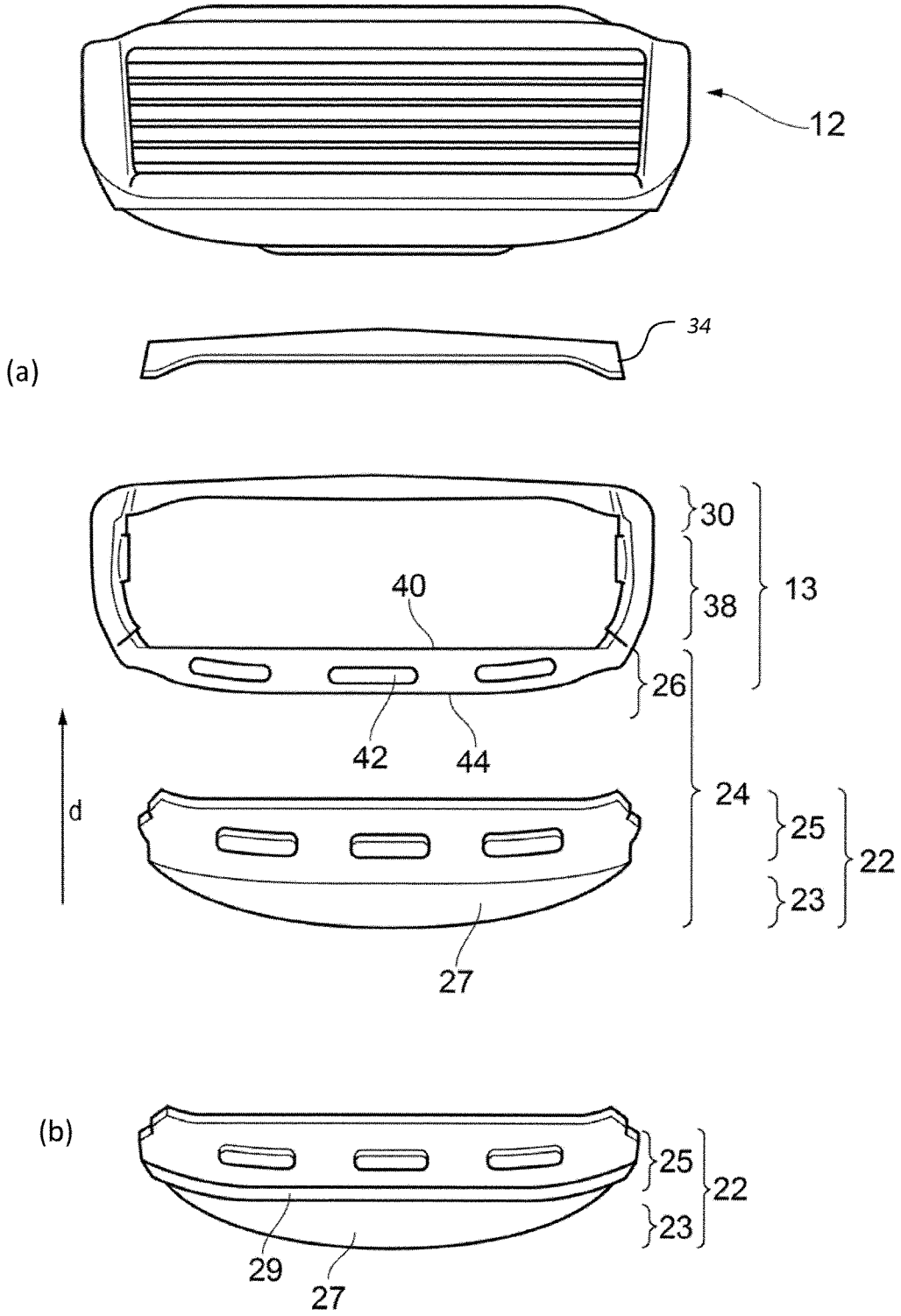
FIGS. 19(*a*) and (*b*) are a top view of dissembled parts of the blade unit shown in FIGS. 1 and 2, and a bottom view of the lubricating pad shown in FIG. 12, respectively.

Reference will now be made to FIGS. 1 to 19, which are views of a blade unit and safety razor including the blade unit, according to embodiments. The safety razor 8 has a blade unit 10 and a handle 16 (only a part of which is shown in FIG. 1). The blade unit 10 includes a connecting structure 14 that fixes the blade unit 10 to the handle 16, a blade housing 12 and a supporting structure 13 of the blade housing 12. The blade housing 12 holds a plurality of blades 18 (five blades in this particular case) having respective cutting edges 20 that lie in a shaving plane P. Thus, as used herein, the term "shaving plane" generally refers to the plane in which cutting edges lie. The direction perpendicular to the shaving plane can be referred to as the thickness direction.

The supporting structure 13 comprises a rear portion 24 located behind the blades in a shaving direction d (when assembled) and a forward portion 30 located in front of the blade in the shaving direction d (when assembled). As used herein, the term "shaving direction" signifies the direction in the shaving plane in which the blade unit is intended to be moved. Also, the direction in which the rear portion 24 protrudes can also be referred to as the protruding direction which is parallel to the shaving direction. The rear portion 24 and the forward portion 30 are connected by side portions 38. The supporting structure 13 controls the contact of the cutting edges 20 of the blades 18 with the skin during shaving.

The rear portion 24 of the supporting structure 13 comprises a non-flexible back portion 26 to which is mounted a lubricating pad 22, two examples of which are shown in FIGS. 19*a* and 19*b*. (For clarity, the lubricating pad 22 is shown separated from the non-flexible back portion 26). In both examples, the lubricating pad 22 comprises a flexible portion 23 and a non-flexible portion 25 that form a continuous shaving aid. However, the thicknesses of the flexible portion 23 are different.

More specifically, in a first example (FIGS. 1 to 11 and 19*a*), a back surface 27 of the lubricating pad 22, opposite to the skin-contacting surface, is planar. In a second example (FIGS. 12 to 18 and 19*b*), a back surface 27 of the lubricating pad 22, opposite to the skin-contacting surface, has an inward step 29. This means that the flexible portion 23 of the lubricating pad 22 can have different thicknesses and thus different degrees of flexibility. In other words, the flexible portion 23 of the lubricating pad 22 can be thicker and therefore relatively more resistant to being bent backwards in a direction perpendicular to and away from the shaving plane, or thinner and therefore relatively less resistant to being bent backwards in a direction perpendicular to and away from the shaving plane. For example, the flexible portion 23 of the second example can be half as thick as the flexible portion 23 of the first example.

The non-flexible back portion 26 of the supporting structure 13 comprises a straight member 40 and an arched member 44 that are connected to each other, so as to define one or more holes 42 in which part of the non-flexible portion 25 of the lubricating pad 22 is disposed when mounted thereon. (When the supporting structure 13 is attached to the blade housing 12, the holes 42 are closed at one end by the blade housing 12 to form recesses.) The flexible portion 23 of the lubricating pad 22 is curved in an arc shape that extends along substantially the entire rear edge 28 between the side portions 38.

The forward portion 30 of the supporting structure 13 comprises a non-flexible back portion 32 on which is mounted an elongate lubricating strip 34. The non-flexible back portion 32 and elongate lubricating pad 34 meet flush at a front edge 36 of the front portion 30 of the blade unit 10. The terms "lubricating strip" and "lubricating pad" are used to signify that the length-to-width ratio in the shaving plane, i.e., the ratio of the size in a direction parallel to the blades (length direction) to the size in a direction parallel to the shaving direction d (width direction), of the elongate lubricating strip 34 and the lubricating pad 22 are different. In this particular case, the elongate lubricating strip 34 and lubricating pad 22 both extend at least along the length of the exposed cutting edges 20 of the blades 18 and have similar length, though the lubricating pad 22 is substantially wider than the elongate lubricating strip 34. In this particular case, the elongate lubricating strip 34 has a length to width ratio of about 10:1, while the lubricating pad 22 has a length-to-width ratio of about 4:1 at its widest point.

The composition of the lubricating strip/lubricating pad can include a gliding agent. Materials which may be selected as the gliding agent are: PEG-400/1,4-Butanediol/SMDI Copolymer, PEG-115M, PEG 45M, and PEG-5M, or a combination thereof. The composition of the lubricating strip/lubricating pad can include an antioxidant agent, for example Tocopherol. The composition of the lubricating strip/lubricating pad can include an anti-inflammatory agent, for example aloe barbadensis leaf juice. The composition of the lubricating strip/lubricating pad can include a backbone structure. Materials which may be selected as the backbone structure are: styrenic block copolymers and polystyrene, or a combination thereof. Preferably, the composition of the lubricating strip and the composition of the lubricating pad are the same, but this need not be the case.

The handle 16 has a proximal portion 46 closer to the blade unit 10 and a distal portion 48 (not shown in FIG. 1)

farther from the blade unit 10. The connecting structure 14 of the blade unit 10 connects (either fixedly or detachably) to the proximal portion 46 of the handle 16. Thus, the blade unit 10 may be configured for use with a separate handle or may be permanently attached to the handle 16. The proximal portion 46 of the handle 16 also includes a pivot mechanism that allows the blade unit 10 to pivot back-and-forth in a plane perpendicular to the shaving plane P. The pivot mechanism can, of course, allow other pivoting motions such as side-to-side. The proximal portion 46 arcuately bends away from the shaving plane P, to permit the rear portion 24 of the blade unit 10 to pivot backwards, i.e., to bend away from the shaving plane, over a large angular range.

The foregoing description of the specific embodiments will so fully reveal the general nature of the invention that others can, by applying knowledge within the skill of the art, readily modify and/or adapt for various applications such specific embodiments, without undue experimentation, without departing from the general concept of the present invention. Therefore, such adaptations and modifications are intended to be within the meaning and range of equivalents of the disclosed embodiments, based on the teaching and guidance presented herein.

For example, although embodiments are described in which separate lubricating elements, i.e., a lubricating strip and a lubricating pad, are provided, such lubricating elements can be a unitary lubricating element which, for example, covers an area of the supporting structure around the blade housing. Furthermore, the lubricating strip need not be provided at all.

Although embodiments are described in which five parallel blades lying in a shaving plane are provided, the blade housing may comprise more than five blades or fewer than five blades, i.e., the blade housing may comprise at least one blade. When mode than one blade is provided, these do not have to lie in a shaving plane, for example the blades could be in a staggered arrangement.

Although embodiments are described in which the shaving aid comprises polymeric material having a lubricating property, the shaving aid may have, either alternatively or in addition, other, e.g., moisturizing, properties considered beneficial during shaving. Furthermore, the shaving aid can take a form other than a pad or a strip. Moreover, the skin-contacting surface of the shaving aid does not have to be smooth but can have, either alternatively or in addition, a finned, holed or other structure.

Although embodiments are described in which the straight and arched member of the rear portion define a plurality of holes (which form recesses when mounted in the blade housing), fewer or no holes (recesses) can be provided.

Although embodiments are described in which the lubricating strip and lubricating pad have particular dimensions, it will be apparent that shaving aids having other dimensions can be employed.

Although embodiments are described in which the rear portion has a non-flexible back portion (which is preferably made from plastic), the non-flexible portion of the lubricating pad can be configured to function as the non-flexible back portion so that the non-flexible back portion can be omitted from the rear portion.

Although embodiments are described in which the back surface of the lubricating pad has an inward step, the back surface of the lubricating pad can be configured so that it continuously thins towards the rear edge. Alternatively or additionally, the skin-contacting surface of the lubricating pad may become (continuously or stepwise) thinner towards the rear edge. Also, instead of an inward step the back surface of the lubricating pad may have a groove.

It is to be understood that the phraseology or terminology herein is for the purpose of description and not of limitation, such that the terminology or phraseology of the present specification is to be interpreted by the skilled artisan in light of the teachings and guidance.

For example, expressions such as "perpendicular", "parallel", "conform to" and the like are defined to mean "substantially perpendicular", "substantially parallel" and "substantially conform to". Likewise, the dimensions and values disclosed herein are not to be understood as being strictly limited to the exact numerical values recited.

Instead, unless otherwise specified, each such dimension is intended to mean both the recited value and a functionally equivalent range surrounding that value. For example, a dimension disclosed as "30%" is intended to mean "about 30%".

The Summary and Abstract sections may set forth one or more but not all exemplary embodiments of the present invention as contemplated by the inventor(s), and thus, are not intended to limit the present invention and the appended claims in any way.

The breadth and scope of the present invention should not be limited by any of the above-described exemplary embodiments, but should be defined only in accordance with the following claims and their equivalents.

REFERENCE NUMBERS d shaving direction
P shaving plane
8 safety razor
10 blade unit
12 blade housing
13 supporting structure
14 connecting structure
16 handle
18 blades
20 cutting edges
22 lubricating pad
23 flexible portion
24 rear portion
25 non-flexible portion
26 non-flexible back portion
27 back surface
28 rear edge
29 inward step
30 forward portion
32 non-flexible back portion
34 elongate lubricating strip
36 front edge
38 side portions
40 straight member
42 hole
44 arched member
46 proximal portion
48 distal portion

What is claimed is:

1. A blade unit for a safety razor, wherein the blade unit comprises:

a connecting structure configured to fix the blade unit to a handle;

a blade housing comprising a plurality of blades having respective cutting edges lying in a shaving plane and being arranged to exert a cutting action when moved across a user's skin in a shaving direction; and a rear portion arranged next to the plurality of blades in the shaving direction, comprising:

a non-flexible back portion extending parallel to the shaving plane, and a lubricating pad consisting of a flexible portion and a non-flexible portion, the non-flexible portion of the lubricating pad being arranged on and supported by the non-flexible back portion, the flexible portion of the lubricating pad extending rearwards from the non-flexible portion of the lubricating pad beyond the non-flexible back portion to define a rear edge of the rear portion of the blade unit, the flexible portion of the lubricating pad being configured to form a convex skin-contacting surface when bending away from the shaving plane in use.

2. The blade unit of claim 1, wherein a back surface of the lubricating pad, opposite to the skin-contacting surface, is planar.

3. The blade unit of claim 2, wherein the flexible portion of the lubricating pad is curved in an arc shape along the rear edge.

4. The blade unit of claim 1, wherein a back surface of the lubricating pad, opposite to the skin-contacting surface, has an inward step.

5. The blade unit of claim 4, wherein the flexible portion of the lubricating pad is curved in an arc shape along the rear edge.

6. The blade unit of claim 1, wherein the flexible portion of the lubricating pad is curved in an arc shape along the rear edge.

7. The blade unit of claim 1, wherein the non-flexible back portion comprises a straight member and an arched member that are connected to each other so as to define at least one hole or recess in which part of the non-flexible portion of the lubricating pad is disposed.

8. The blade unit of claim 1, wherein the blade unit further comprises a forward portion arranged next to the plurality of blades in the shaving direction on an opposite side of the rear portion, comprising a non-flexible back portion parallel to the shaving plane, and an elongate lubricating strip arranged on and being supported by the non-flexible back portion and which extends up to a front edge of the forward portion of the blade unit.

9. The blade unit of claim 8, wherein a skin-contacting surface area of the lubricating pad is greater than a skin-contacting surface area of the elongate lubricating strip.

10. The blade unit of claim 8, wherein the rear portion of the blade unit and the forward portion of the blade unit are connected by side portions of the blade unit, to define a supporting structure of the blade housing.

11. The blade unit of claim 8, wherein the lubricating pad and elongate lubricating strip extend along at least 60% of an outer perimeter of the blade unit when viewed from a direction perpendicular onto the shaving plane.

12. The blade unit of claim 8, wherein the lubricating pad and elongate lubricating strip extend along at least 80% of an outer perimeter of the blade unit when viewed from a direction perpendicular onto the shaving plane.

13. The blade unit of claim 1, wherein the lubricating pad extends along at least 30% of an outer perimeter of the blade unit when viewed from a direction perpendicular onto the shaving plane.

14. The blade unit of claim 1, wherein the lubricating pad extends along at least 40% of an outer perimeter of the blade unit when viewed from a direction perpendicular onto the shaving plane.

15. A safety razor, wherein the safety razor comprises the blade unit of claim 1 and a handle having a proximal portion to which the blade unit is fixed and a distal portion.

16. The safety razor of claim 15, wherein the proximal portion arcuately bends away from the shaving plane.

17. The safety razor of claim 16, wherein the proximal portion comprises a non-flexible annular rim surrounding a flexible elastic portion to which connecting structure is attached.

18. The safety razor of claim 15, wherein the proximal portion comprises a non-flexible annular rim surrounding a flexible elastic portion to which connecting structure is attached.

19. The safety razor of claim 15, wherein the connecting structure is at an off-centered position of the flexible elastic portion relative to the non-flexible annular rim.

20. A method of manufacturing a blade unit for a safety razor, wherein the method comprises:

providing a connecting structure configured to fix the blade unit to a handle;

providing a blade housing comprising a plurality of blades having respective cutting edges lying in a shaving plane and being arranged to exert a cutting action when moved across a user's skin in a shaving direction; and providing a rear portion arranged next to the plurality of blades in the shaving direction, comprising:

a non-flexible back portion extending parallel to the shaving plane, and a lubricating pad consisting of a flexible portion and a non-flexible portion, the non-flexible portion of the lubricating pad being arranged on and supported by the non-flexible back portion, the flexible portion of the lubricating pad extending rearwards from the non-flexible portion of the lubricating pad beyond the non-flexible back portion to define a rear edge of the rear portion of the blade unit, the flexible portion of the lubricating pad being configured to form a convex skin-contacting surface when bending away from the shaving plane in use.

* * * * *